United States Patent [19]

Schueler

[11] Patent Number: 4,882,800

[45] Date of Patent: Nov. 28, 1989

[54] FLOTATION MATTRESS

[76] Inventor: Tyler E. Schueler, 30 Winchester Dr., Huntington, Conn. 06484

[21] Appl. No.: 237,530

[22] Filed: Aug. 29, 1988

Related U.S. Application Data

[63] Continuation-in-part of Ser. No. 56,713, Jun. 2, 1987, Pat. No. 4,766,629.

[51] Int. Cl.[4] ..... A47C 27/10

[52] U.S. Cl. ..... 5/451; 5/455; 5/465

[58] Field of Search ..... 5/451, 452, 450, 455, 5/449, 457, 422, 468, 424, 465

[56] References Cited

U.S. PATENT DOCUMENTS

| | | | |
|---|---|---|---|
| 529,852 | 11/1894 | Brupbacher | 5/449 |
| 1,576,211 | 3/1926 | O'Kane | 5/455 |
| 2,731,652 | 1/1956 | Bishop | 5/455 |
| 3,089,153 | 5/1963 | Bosc | 5/455 |
| 3,253,861 | 5/1966 | Howard | 5/468 |
| 3,705,429 | 12/1972 | Nail | 5/455 |
| 3,766,579 | 10/1973 | Shields | 5/451 |
| 3,848,282 | 11/1974 | Viesturs | 5/451 |
| 4,442,556 | 4/1984 | Craigie | 5/465 |
| 4,459,714 | 7/1984 | Lin | 5/451 |
| 4,501,036 | 2/1985 | Santo | 5/452 |
| 4,513,463 | 4/1985 | Santo | 5/452 |
| 4,517,692 | 5/1985 | Vogel | 5/451 |
| 4,534,078 | 8/1985 | Viesturs et al. | 5/451 |
| 4,611,357 | 9/1986 | Chelin | 5/451 |

FOREIGN PATENT DOCUMENTS

| | | | |
|---|---|---|---|
| 3535374 | 4/1987 | Fed. Rep. of Germany | 5/455 |
| 1034137 | 7/1953 | France | 5/455 |
| 2435245 | 5/1980 | France | 5/451 |
| 331459 | 7/1958 | Switzerland | 5/457 |
| 787421 | 12/1957 | United Kingdom | 5/457 |

*Primary Examiner*—Alexander Grosz

*Attorney, Agent, or Firm*—Sixbey, Friedman, Leedom & Ferguson

[57] ABSTRACT

The flotation mattress includes an outer cover which defines an enclosed inner area divided into three sequential sections by transverse dividing walls. Each section includes alternating water columns and ventilation chambers arranged across the section between raised air baffles extending along the outer longitudinal edges of each section. The water columns are of maximum cross-sectional area adjacent the top surface of the mattress and of minimal cross-sectional area adjacent the bottom surface of the mattress. The intervening ventilation chambers are open to the atmosphere and are of minimal cross-sectional area adjacent the top surface of the mattress. In another embodiment, the mattress is divided into three separate sequential sections which are selectively interlockable, the sections having air baffles which can be rotated from the plane of the mattress to cradle a user atop the alternating water columns and ventilation chambers.

25 Claims, 7 Drawing Sheets

FLOTATION MATTRESS

This is a continuation-in-part of application Ser. No. 056,713, filed June 2, 1987now U.S. Pat. No. 4,766,629, entitled "Flotation Mattress."

BACKGROUND OF THE INVENTION

Technical Field

The present invention relates to mattresses generally, and more particularly to a novel and improved lightweight flotation mattress designed to reduce the surface pressure that is created when a patient is confined on the mattress for long periods of time, or for burn patients.

Bedridden patients in hospitals, nursing homes, and in home care situations often develop decubitus ulcers as a result of their confinement. In an attempt to prevent the formation of decubitus ulcers or bed sores, a number of flotation mattresses have been designed to provide enhanced support for bedridden patients. A large number of these flotation mattresses embody water flotation systems providing a type of support which permits bed sores to be successfully treated and healed. However, water flotation mattresses have been subject to a number of disadvantages which have proven difficult to overcome. For example, most of these mattresses require special supporting frames capable of sustaining the weight of a water-filled flotation mattress. Consequently, such flotation mattresses are either not designed for use on conventional hospital beds, or when such use is possible, adversely affect the operation of the hosptial beds. The normal hospital bed is not designed filled flotation mattress in addition to the weight of the patient, and such mattresses are not capable of flexing with a hospital bed when it is moved to a raised position.

In the past, attempts have been made to lower the weight of a water-filled flotation mattress so that the mattress can be supported on a hosptial bed. For example, U. S. Pat. No. 3,848,282 to E. A. Viesturs discloses a lightweight flotation mattress wherein tie strips internally positioned within the mattress limit the amount of water needed to fill the mattress and, thus, the mattress weight. The same patent discloses eliminating the pillow area of the mattress to further reduce the weight of the water needed to support the patient. Also, U.S. Pat. Nos. 4,534,078 to Viesturs et al, 4,501,036 and U.S. Pat. No. 4,513,463 to Santo disclose water-filled mattresses having peripheral air chambers. With portions of the mattress being filled with pressurized air, the overall weight is somewhat reduced.

Also, U.S. Pat. No. 3,766,579 to Shields discloses a water bed having a compartmentalized air beam structure combined with a water mattress. This structure is of less weight than a similar structure completely filled with water, as is the flotation mattress shown by U.S. Pat. No. 4,517,692 to Vogel which incorporates a foam frame in combination with a water-filled mattress structure.

Although these prior art flotation mattress structures have, to some extent, successfully reduced the overall flotation mattress weight, the structures are still often quite heavy. One solution to the problem of weight is the total elimination of water, approximating its element of support by using internal air beam structures within an outer air mattress as disclosed in U.S. Pat. No. 3,705,429 to Nail.

A universal problem with known flotation mattresses is the lack of ventilation provided to the patient supported thereby. Since these mattresses must be formed from waterproof material, there is no opportunity for air to pass through the mattress and reach the patient. The failure to ventilate the patient's body offsets, to some degree, the beneficial action of flotation mattresses in treating or preventing decubitus ulcers. Some early attempts were made to provide ventilation compartments within water-filled mattresses, as illustrated by U.S. Pat. No. 529,852 to Brupbacher, but enclosed ventilation compartments of the type shown by this patent having little access to the outside atmosphere are only minimally effective. Likewise, U.S. Pat. No. 3,089,153 to Bosc disclosing an air mattress of alternating air -filled chambers with ventilation chambers suffers the same limitation.

DISCLOSURE OF THE INVENTION

From the foregoing, it will be appreciated that there is a need for a flotation mattress which is both light in weight and flexible, while providing a combination of the enhanced support of a water-filled unit while effectively ventilating the body of a patient using the mattress. It is a primary object of this invention to provide such a flotation mattress.

Another object of the present invention is to provide a novel and improved flotation mattress having a combination of internal water-filled chambers, chambers filled with pressurized air, and ventilation chambers which are open to the atmosphere. These chambers are arranged within three separate mattress sections which are relatively pivotal to permit the mattress to flex with a hospital bed which is moved to a raised position.

Yet another object of the present invention is to provide a novel and improved flotation mattress having alternating water-filled and ventilation chambers which are arranged longitudinally of the mattress and which extend alternatively across the width of the mattress. The water-filled chambers are designed so as to provide maximum fluid support of the patient at the upper surface of the mattress while the intervening ventilation chambers are formed to have maximum exposure to the atmosphere at the bottom surface of the mattress.

A further object of the present invention is to provide a novel and improved flotation mattress wherein movement and motion discomfort are controlled by raised sides and an internal I-beam and special baffle construction. Reinforced I-beam panels extending across the width of the mattress and between the upper and lower panels thereof provide enhanced stability for the mattress. Three individual pressurized air baffles arranged longitudinally on each side of the mattress cradle the patient within the center water-supported portion of the mattress.

Yet a further object of the present invention is to provide a novel and improved flotation mattress which provides the advantage of water support for a patient in combination with enhanced undermattress and patient body ventilation which is provided by internal ventilation chambers. The patient is positioned on the mattress by longitudinal air-filled baffles which rise above the mattress surface and which, with the ventilation chambers and the design of special water-filled chambers, minimize the operative weight of the mattress.

Another object of the present invention is to provide a novel and improved flotation mattress having separable head, center and foot sections. This permits the center section to be attached to only the head or foot section to provide localized support. Also each section may be attached at only the upper surface of the mattress to permit the head and foot sections to pivot angularly relative to the center section.

A still further object of the present invention is to provide a novel and improved flotation mattress having separable head, center and foot sections, each of which includes alternating water-filled and ventilation chambers which are arranged longitudinally of the section and extend alternatively across the width of a central area of each section. Air baffles are provided which extend longitudinally along the sides of each section and which may be folded upwardly and over against the top panel for the central area of the section to provide side bolsters for that respective section. When the head, foot and center sections of the mattress are connected together, the air baffles for one, two, or all of the sections may be folded to provide bolsters.

A still further object of the present invention is to provide a novel and improved flotation mattress having head, center and foot sections, each of which includes alternating water-filled and ventilation chambers which are arranged longitudinally of the section and extend alternatively across the width of a central area of each section. The foot section includes an air baffle which extends transversely across the end thereof and which may be folded upwardly and over against the top panel for the foot section to form a raised foot and leg supporting surface.

These and other objects of the present invention are achieved by forming a flotation mattress from an elongated top and bottom panel which are joined to a side panel extending around the periphery of the mattress. Internally, the mattress is divided into three sections by I-beam shaped reinforcing panels which extend transversely across the width of the mattress and join the top panel to the bottom panel. Alternatively, the reinforcing panels are eliminated and the three sections of the mattress are separable into individual interlockable units for easier handling and for providing support to a limited body area when the use of the entire mattress is not required for a particular patient. Each of these three internal mattress sections includes longitudinally extending baffles or air chambers on opposite sides thereof which, when filled with air, extend above the remainder of the surface of the top panel. The mattress sections also include longitudinally extending ventilation chambers and water-filled columns which alternate across the width of the mattress between the spaced air-filled baffles. Preferably, the water-filled columns are of maximum cross-sectional area adjacent the top panel of the mattress and of minimum cross-sectional area adjacent the bottom panel, while the ventilation chambers have a minimum cross-sectional area adjacent the top panel and a maximum cross-sectional area adjacent the bottom panel. These ventilation chambers have ventilation holes which open through the top panel between the water columns, and the ventilation chambers are open at the bottom panel of the mattress. All of the water-filled columns within a section of the mattress are joined by transversely extending water ducts so that all columns within a section may be filled from a single nozzle assembly for that section.

Figure 6:
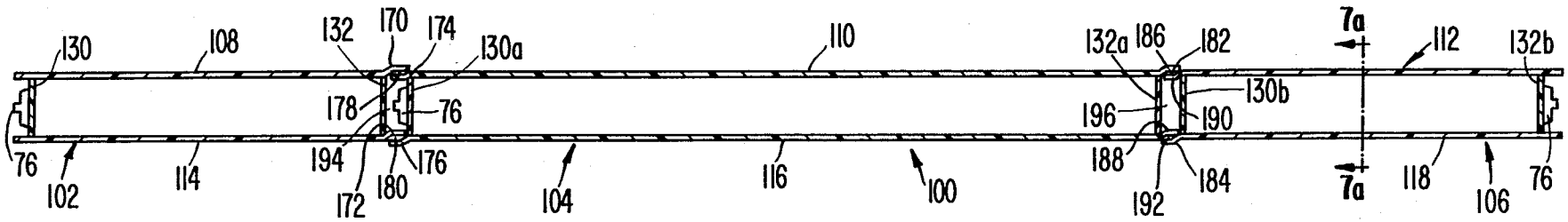
FIG. 6 is a longitudinal sectional view of a second embodiment of the flotation mattress of the present invention.
Figure 7B:
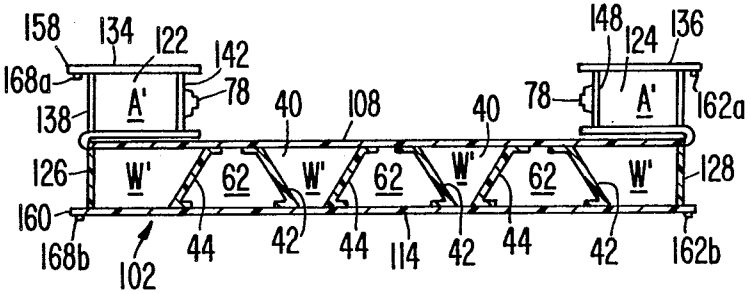
Figure 7A:
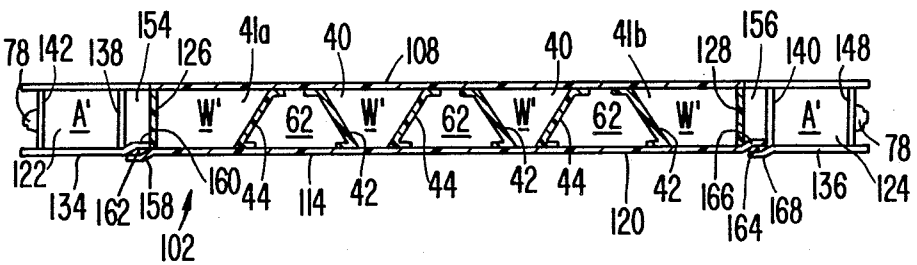
Figure 8:
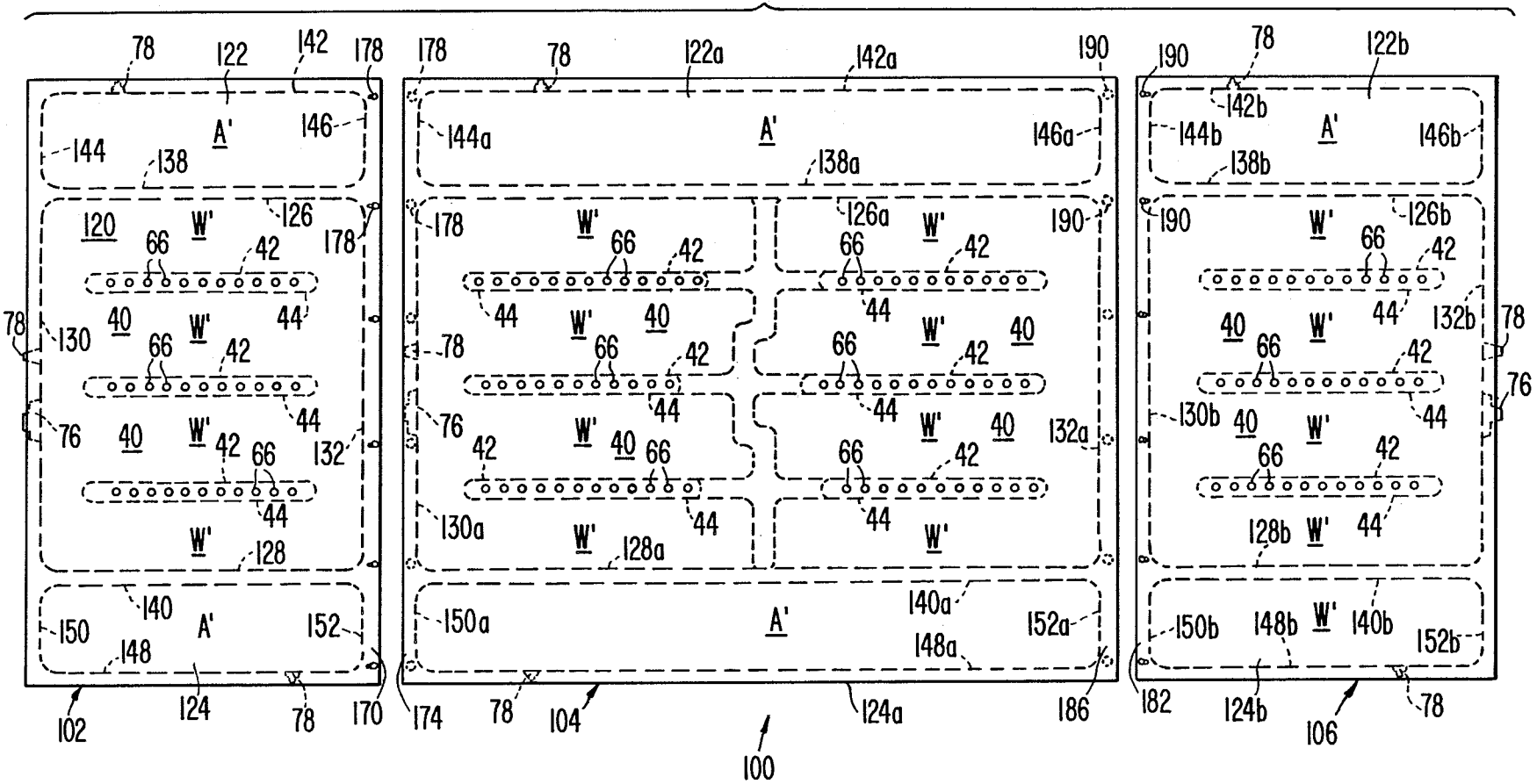
Figure 9:
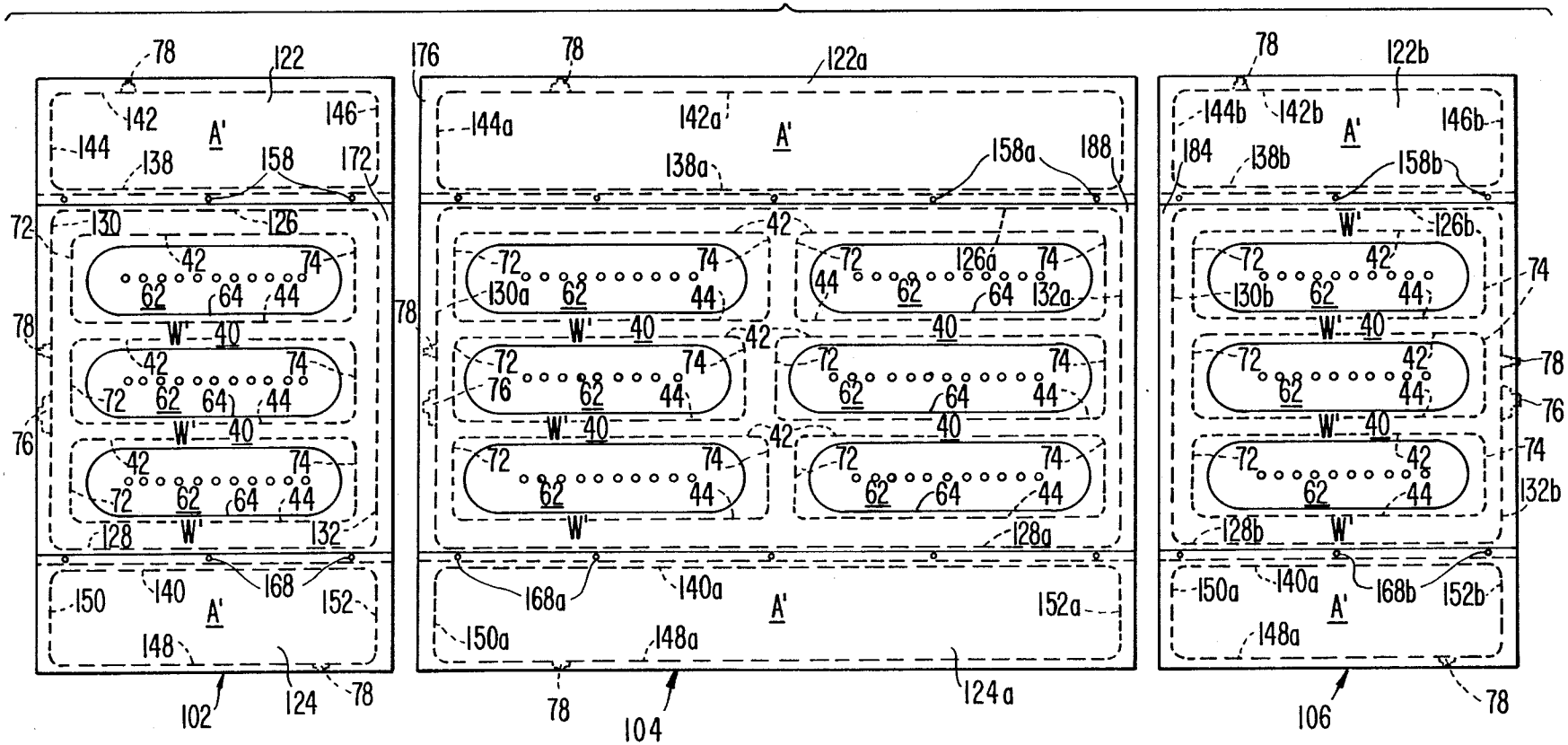
Figure 10A:
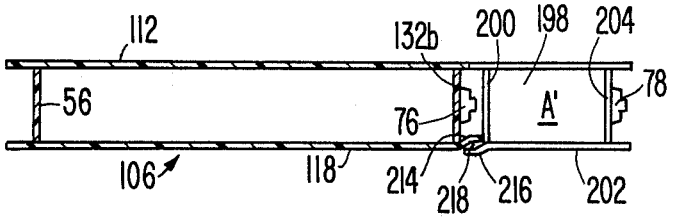
Figure 10B:
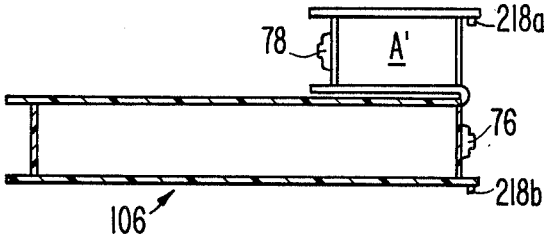
Figure 11:
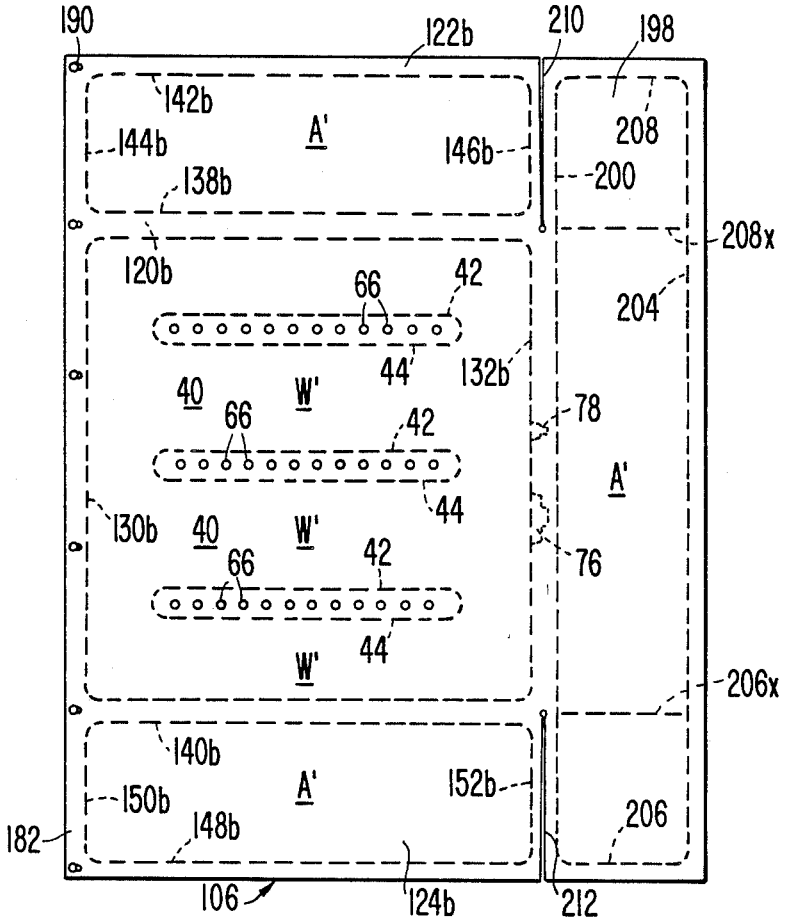

FIG. *7a* is a sectional view of the head section of the flotation mattress in FIG. 6, with the side air baffles in the plane of the mattress, the structure being common to all sections;

FIG. *7b* illustrates a transverse sectional view of the head section of the flotation mattress, in FIG. 6, with the side air baffles in the maximum rotation position, the structure being common to all sections;

FIG. 8 is a top plan view of the flotation mattress of FIG. 6, with sections detached and with the internal mattress structure shown in broken lines;

FIG. 9 is a bottom plan view of the flotation mattress of FIG. 6, with sections detached, and with the internal mattress structure shown in broken lines;

FIG. 10*a* is a longitudinal sectional view of a second embodiment of the foot section for the flotation mattress of the present invention, with the end air baffle in the plane of the foot section;

FIG. 10*b* is a longitudinal sectional view of the foot section of FIG. 10*a*, with the end air baffle in the maximum rotation position; and FIG. 11 is a top plan view of the foot section embodiment of FIG. 10*a*, with the internal mattress structure shown in broken lines.

BEST MODE FOR CARRYING OUT THE INVENTION

The novel flotation mattress of the present invention indicated generally at 10 includes an elongate top panel 12 which is spaced from a similarly shaped elongate bottom panel 14. The top and bottom panels are joined together by a side panel 16 which extends around the periphery of the mattress and is joined to the top panel by an upper peripheral seam 18 and to the bottom panel by a lower peripheral seam 20. The top, bottom and side panels may be constructed of any material commonly used in the formation of flotation mattresses, such as vinyl or nylon bonded to vinyl. The various seams which join portions of the flotation mattress together may be formed by electronic heat sealing or welding, or other suitable joining methods which will create a strong, waterproof structure.

The flotation mattress 10 is internally divided into three sections 22, 24, and 26 by transversely extending interior panels 28 and 30. The section 22 forms a head section for the mattress while the section 26 forms a foot section. Section 24 is an intermediate section between the head and foot sections and extends for substantially twice the length of the head and foot sections. It should be noted that the interior panels 28 and 30 are each formed from two oppositely disposed C-shaped sections 28*a*, 28*b* and 30*a* and 30*b*. These C-shaped sections are relatively spaced and are joined to the top and bottom panels 12 and 14 of the flotation mattress. Each pair of C-shaped panels forms an I-beam construction which impart support to the mattress at the joinder line between mattress sections, but which permits the mattress to pivot upwardly in the area between a pair of C-shaped panels. Thus, the mattress conforms to the pivotal head and foot sections of a conventional hospital bed and will easily pivot to a position conforming with the position of the hospital bed. Also, the mattress can be easily folded and moved to new locations.

Figure 1:
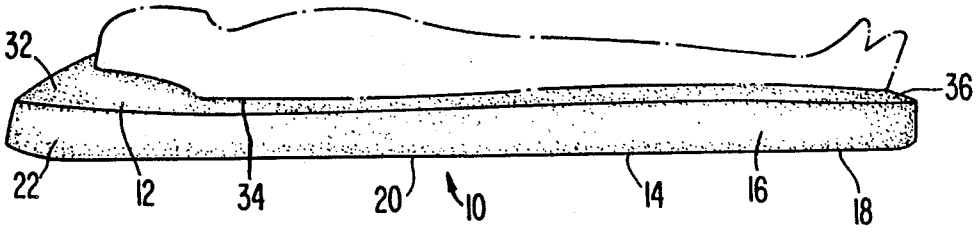
FIG. 1 is a side perspective view of the flotation of the present invention.
Figure 2:
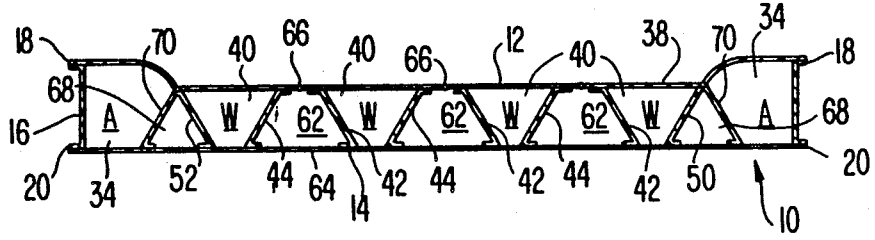
FIG. 2 is a transverse sectional view of the flotation mattress of FIG. 1.
Figure 4:
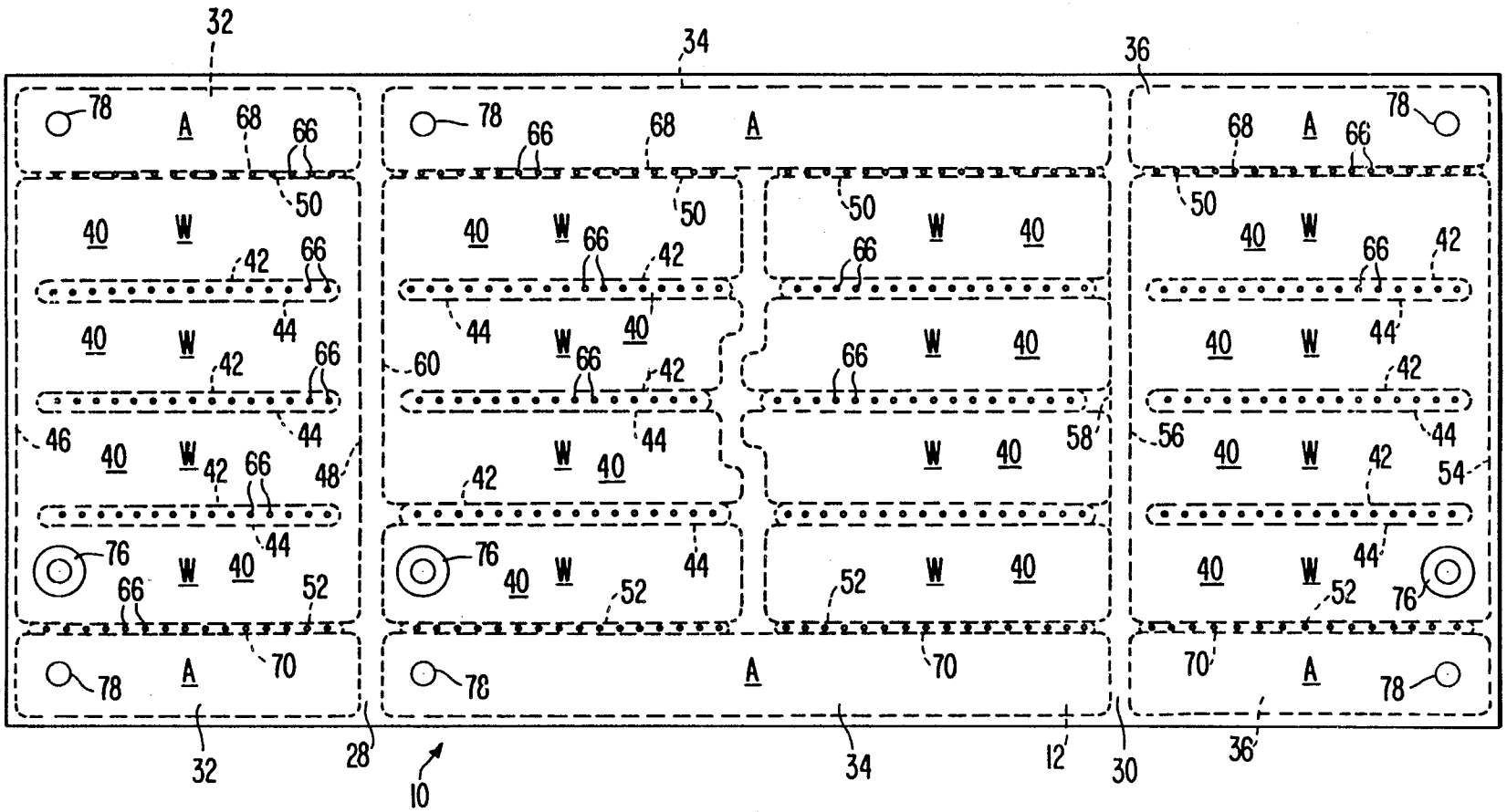
FIG. 4 is a top plan view of the flotation mattress of FIG. 1 with the internal mattress structure shown in broken lines.
Figure 5:
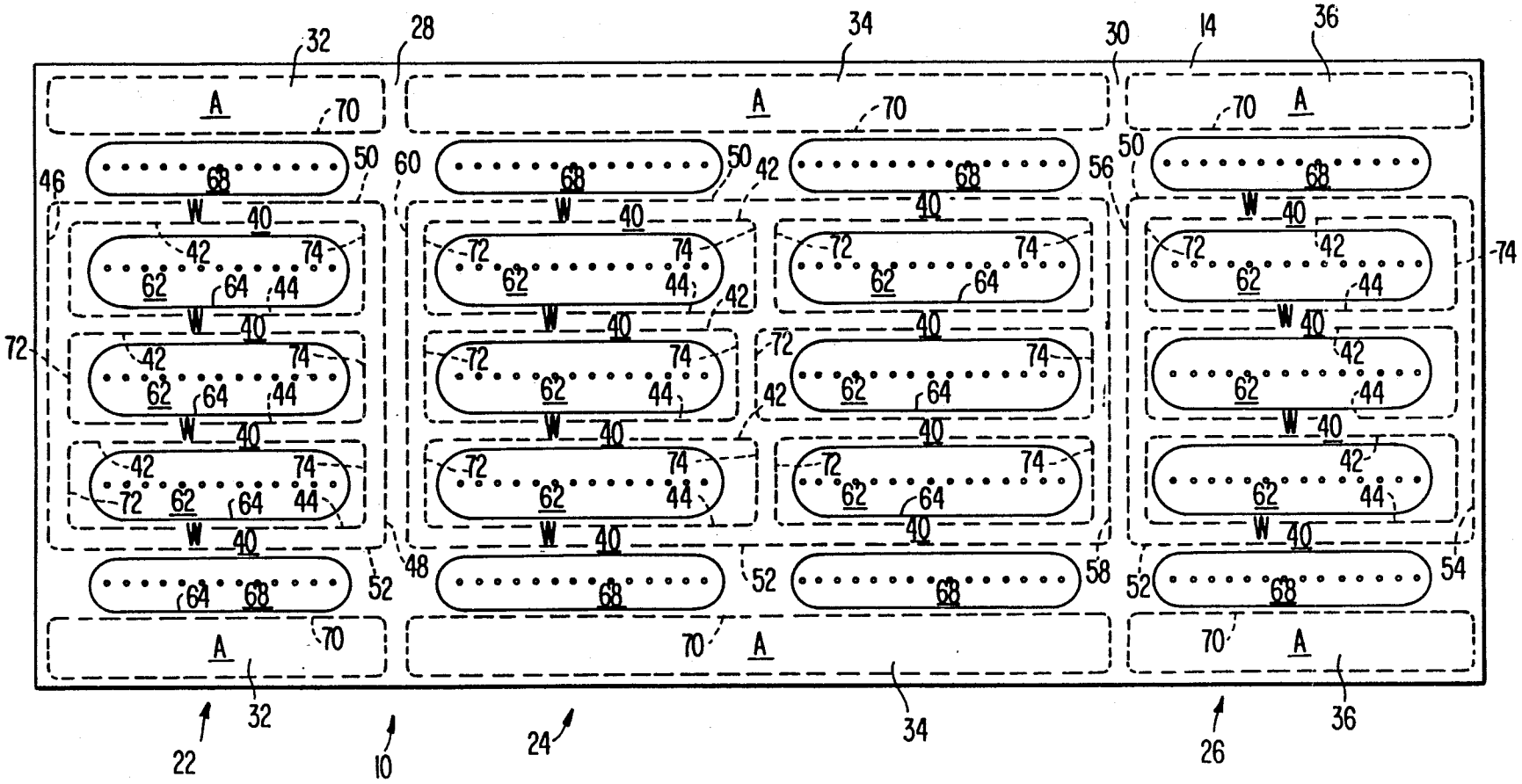
FIG. 5 is a bottom plan view of the flotation mattress of FIG. 1 with the internal mattress structure shown in broken lines.

With reference to FIGS. 2, 4 and 5, it will be noted that the head section 22, middle section 24 and foot section 26 of the flotation mattress 10 are bounded by spaced, longitudinally extending air baffles indicated by the letter A. Thus, the head section includes a pair of spaced air baffles 32, the middle section a pair of spaced air baffles 34, and the foot section a pair of spaced air baffles 36. Each air baffle terminates before it reaches an interior panel 28 or 30 to permit bending of the flotation mattress. It will be noted from FIG. 2 that the air baffles extend upwardly along the longitudinal sides of the mattress 10 and above the top surface of a central portion 38 of the mattress. This central portion includes water and ventilation chambers to be subsequently described. As will be noted from FIG. 1, the upwardly extending air baffles cradle a patient supported by the mattress in the central portion 38, and prevent the patient from rolling off the mattress.

In each of the mattress sections 22, 24 and 26, the central portion 38 of the mattress is formed by alternating water columns and ventilation chambers which extend longitudinally and alternate across the width of the mattress. The water columns, which are indicated by the letter W, are indicated at 40 in FIG. 2 and are substantially V-shaped in configuration. Each water column is bounded by inclined sidewalls 42 and 44 which angle outwardly from a line of attachment with the bottom panel 14 to a line of attachment with the top panel 12. Thus, the water column defined by the sidewalls 42 and 44 is of minimum width in the area adjacent the bottom panel and is of greatest width at the area beneath the top panel of the flotation mattress 10.

As will be noted from FIGS. 4 and 5, all of the water columns 40 in each of the mattress sections are interconnected, so that all may be filled from a single fill spout for the section. Thus, in the head section 22, the inclined sidewalls 42 and 44 which define each water column stop short of end walls 46 and 48. These end walls are watertight walls which extend between the top panel 12 and the bottom panel 14 and are formed integrally with sidewalls 50 and 52. The sidewalls 50 and 52 are inclined outwardly from the bottom panel 14 toward the top panel 12 to complete the end water columns 40 in each of the mattress sections.

Like the head section 22, the foot section 26 and middle section 24 also include closed conduits between the water columns 40. In the foot section, end walls 54 and 56 join with inclined sidewalls 50 and 52 to form a closed water section, while in the middle section 24, end walls 58 and 60 similarly join with sidewalls 50 and 52. The end walls 58 and 60 define two rows of water columns rather than the single row incorporated in the head and foot sections.

Referring again to FIG. 2, it will be noted that the inclined sidewalls 42 and 44, as well as the end walls 50 and 52, not only define the water columns 40 but also define intervening ventilation chambers 62. Like the water columns 40, the ventilation chambers 62 extend longitudinally of the flotation mattress 10 between the water columns. The ventilation chambers are substantially the same size as the water columns but are in an inverted relationship with the narrowest portion of the ventilation chamber being adjacent the top panel 12 and the widest portion being adjacent the bottom panel 14. The ventilation chambers are completely separate from the water columns 40 and open through the bottom panel 14 as indicated at 64. Also, the ventilation chambers communicate with the atmosphere through rows of holes 66 which extend through the top panel 12 into each ventilation chamber.

Smaller ventilation chambers 68 are formed on opposite sides of each mattress section to extend between the inclined end walls 50 and 52 and inclined inner walls 70 for each of the air baffles 32, 34 and 36. The smaller ventilation chambers 68 are substantially identical in construction to the larger ventilation chambers 62 and include bottom openings 64 as well as small vent holes 66.

With reference to FIG. 5, it will become apparent from the broken lines which disclose the water path between the water columns 40 in each mattress section that all such water columns in a mattress section are interconnected. Also, it will be noted that each ventilation chamber is completely closed off from the path of water flowing through a respective mattress section. Thus, each ventilation chamber 62 is closed by two end walls 72 and 74 which extend between the sidewalls 42 and 44. In the head section 22 of the flotation mattress 10, the end walls 72 and 74 are spaced from the end walls 46 and 48, respectively, to create a connecting passageway between the various water columns 40. Similarly, in the foot section 26, connecting passages are formed by the end walls 72 and 74 being spaced from the end walls 56 and 54, respectively.

In the middle section 24 of the mattress 10, the outermost end walls 72 and 74 for each pair of ventilation chambers 62 are spaced from the end walls 60 and 58, respectively, while the innermost end walls 72 and 74 of each pair of ventilation chambers are spaced from each other. This creates water flow passages both along the outer edges of the middle section connected to each of the water columns 40, as well as a water passage through the center portion of the middle section which connects to each water column.

The water columns 40 in each section of the flotation mattress 10 may be filled with water or drained through a suitable fill spout assembly 76 communicating in each section with one of the water columns 40. Air under pressure is provided to each of the air baffles 32, 34 and 36 by a suitable air valve 78 associated with each individual air baffle. The water columns 40 can, in some instances be filled with other fluids or materials such as air or gel. Some such materials may reduce the weight reduction characteristics of the mattress to a great extent, but the superior flexibility and ventilation advantages are retained.

Figure 3:
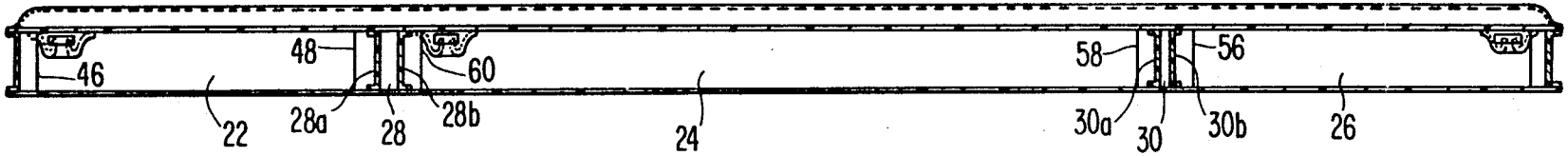
FIG. 3 is a longitudinal sectional view of the flotation mattress of FIG. 1.

FIGS. 6, 7*a*, 7*b*, 8 and 9 illustrate another embodiment of the flotation mattress of the present invention indicated generally at 100 which provides added advantages in use. Here, the mattress 100 is divided into three separate sections in the areas between the interior panels 28 *a–b* and 30*a–b* of FIG. 3. Thus, the mattress 100 includes three separable sections including a head section 102, a center section 104, and a foot section 106 which exist as individual units having attachment means for integrating these units to form part of, or the entire flotation mattress. The mattress 100 includes a variation of the spaced, longitudinal air baffles 32, 34 and 36 of the mattress 10 which can be used to cradle the patient in a central position on the mattress. Also, the fill spout assemblies 76 and the air valve 78 on the mattress 10 are provided in different positions on the mattress 100.

Each of the three sections 102, 104 and 106 of the mattress 100 has an elongate top panel 108, 110 and 112, respectively, which is spaced from elongate bottom panels 114, 116 and 118, respectively. As will be hereinafter described, the top panels 108, 110 and 112 are greater in width than the bottom panels 114, 116 and 118. The top panel and bottom panel of each mattress section are joined together by intervening tie walls which, for each section, form sidewalls and end walls to provide continuous peripheral walls for a central portion of each section contains the water-filled chambers and ventilation chambers.

Each of the individual mattress sections 102, 104 and 106 is formed in substantially the same manner, with the only difference being that the center section 104 is of greater length than the remaining two sections. Consequently, the structure of these sections will be specifically described with respect to the head section 102 in FIGS. *7a* and *7b*, and it will be recognized that the center section 104 and foot section 106 are similarly formed and operated in a similar manner. Structural components of the mattress 100 which are identical to those shown relative to the mattress 10 are given like reference numerals, and structural components of the center section 104 and foot section 106 which are identical to those described in connection with the head section will be given like reference numerals designated by the letter "a" for the center section and the letter "b" for the foot section.

Referring now to FIGS. *7a* and *7b*, it will be noted that the top panel 108 extends over a central area 120 which is bordered on either side by spaced, longitudinally extending air baffles 122 and 124. These air baffles are spaced from the central area and it will be noted that the top panel extends outwardly from the central area as a unitary panel over both of the air baffles.

The central area is bounded by sidewalls 126 and 128 which, with end walls 130 and 132 that also extend between the top and bottom panel, enclose the central area 120. Within the enclosed central area 120 are the water columns W and the intervening ventilation chambers 62 bounded by the inclined sidewalls 42 and 44 as previously described.

The air baffles 122 and 124 are covered by an extension of the top panel 108 and the air baffle 122 includes a separate bottom panel 134 while the air baffle 124 includes a separate bottom panel 136. The air baffle 122 includes an inner sidewall 138 extending between the top panel 108 and the bottom panel 134 and spaced from the sidewall 126, while the air baffle 124 includes an inner sidewall 140 extending from between the top panel and the bottom panel 136 and spaced from the sidewall 128. Enclosure of the air baffle 122 is completed by an outer sidewall 142 extending between the top panel 102 and the bottom panel 104, and end walls 144 and 146 which extend between the top and bottom panels. Similarly, the air baffle 124 is enclosed by an outer sidewall 148 extending between the top and bottom panels 108 and 136, and end walls 150 and 152 which similarly extend between the top and bottom panels. Thus it can be seen that the air baffles 122 and 124 are separate units which are joined to the central area 120 by the top panel 108. However, these air baffles are spaced from the central area to provide intervening spaces 154 and 156.

The bottom panel 134 of the air baffle 122 extends outwardly beyond the inner sidewall 138 as indicated at 158, while the bottom panel 114 extends outwardly beyond the sidewall 126, as indicated at 160. The extensions 158 and 160 provide longitudinally extending flaps which may be provided with suitable fasteners 162 such as snaps, buttons and button holes, or the like. Thus, the extension 158 may be secured to the extension 160, or may be separated therefrom.

Similarly, the bottom panel 136 for the air baffle 124 extends outwardly beyond the inner sidewall 140 as indicated at 164, while the bottom panel 114 extends outwardly beyond the sidewall 128 as indicated at 166. Again, these extensions 164 and 166 may be provided with suitable fasteners 168. As illustrated in FIGS. *7a* and *7b*, the fasteners 162 and 168 may be engaged to provide a flat mattress surface as shown in FIG. *7a*, or the fasteners may be disengaged so that the air baffles 122 and 124 may be folded upwardly and brought over on top of the top panel 108. In this configuration, the top panel acts as a hinge so that the portions thereof which cover the air baffles are permitted to lay flat against the portions thereof which overlie the peripheral longitudinal edges of the central area 120. As will be noted, in this position, the engaging parts of the fasteners 162 and 168 are widely separated as indicated at 162*a–b* and 168*a–b*.

Referring back to FIG. 6, the structure for selectively separating or joining the head, center, and foot sections of the flotation mattress 100 is illustrated. The top and bottom panels 108 and 114 of the head section 102 extend outwardly beyond the end walls 132, 146 and 152 as indicated at 170 and 172, respectively. Similarly, the top and bottom panels 110 and 116 of the center section 104 extend outwardly beyond the end walls 130*a*, 144*a* and 150*a* as indicated at 174 and 176, respectively. Suitable fasteners 178 are provided on the extensions 170 and 174 so that these extensions may either be secured together or released, while suitable fasteners 180 may be provided upon the extensions 172 and 176 so that these extensions may likewise be either secured together or released.

Similarly, the top panel 112 and bottom panel 118 of the foot section 106 extend outwardly beyond the end walls 130*b*, 144*b* and 150*b* at 182 and at 184, respectively. While the top and bottom panels 110 and 116 for the center section 104 extend outwardly beyond the end walls 132*a*, 146*a* and 152*a* at 186 and 188, respectively. The top extensions 182 and 186 are provided with suitable fasteners 190 while the bottom extensions 184 and 188 may be provided with suitable fasteners 192 to permit the sections to be joined together or separated.

It will be noted from FIG. 6 that when the head, center and foot sections are joined together, spaces 194 and 196 are provided between the sections. The spaces provide room for the water spout 76 and air valves 78 for the center section 104 which are formed on the end wall 130*a*. The water fill spout 76 and air valve 78 are formed on the end wall 130 for the head section 102 and on the end wall 132*b* for the foot section 106.

In some instances, it is desirable to omit the fasteners 180 and 192, so that the mattress sections are joined together at the top panel only. This permits more flexibility and permits relative angular adjustment between mattress sections. Thus, the head or foot section could be raised relative to the central section as, for example, in a hospital bed. This configuration is illustrated in FIGS. 8 and 9, wherein it will be noted in FIG. 8 that the top panel fasteners are provided, while in FIG. 9, the bottom panel fasteners are omitted.

In FIGS. 8 and 9, it will be noted that the basic construction of the mattress 100 is similar to that of the mattress 10, and the same reference numerals are used for identical structural units. Consequently, since these elements are identical in both structure and function to those previously described, they will not be redescribed in connection with FIGS. 8 and 9.

FIGS. 10*a*, 10*b* and 11 disclose another embodiment of the foot section 106 wherein a transversely extending, foldable air baffle 198 is secured thereto in spaced relation to the end wall 132*b*. In this embodiment, the top panel 112 extends outwardly beyond the end wall 132*b* and over the air baffle 198 to form the top wall of the air baffle. The air baffle is enclosed by an inner end wall 200 which is spaced from the end wall 132*b* and which extends between the top panel 112 and a separate bottom panel 202 for the air baffle. The air baffle is further bounded by an outer end wall 204 and sidewalls 206 and 208 which also are connected between the top panel 112 and the bottom panel 202. Thus, the end walls 200 and 204 and the sidewalls 206 and 208 form an enclosed air baffle.

As previously indicated, the top panel 112 extends over the air baffle 198 and connects this baffle to the foot section 106. To permit both the side air baffles 122*b* and 124*b* for the foot section to fold relative to the central area 120*b* thereof, and similarly to facilitate folding of the air baffle 198 relative to the central area 120*b*, the top panel 112 is slit inwardly on either side as indicated by the slits 210 and 212. These slits extend inwardly between the end walls 146*b* and 152*b* of the air baffles 122*b* and 124*b* and the end wall 200 of the baffle 198. If it should be desirable to permit both the side baffles 122*b* and 124*b* and the end baffle 198 to be folded upwardly simultaneously, the slits 210 and 212 would be eliminated and the sidewalls 206 and 208 of the baffle 198 would be moved inwardly to the broken line positions indicated at 206*x* and 208*x*.

As illustrated in FIGS. 10*a* and 10*b*, the bottom panel 118 for the foot section 106 extends outwardly beyond the end walls 132*b*, 146*b* and 152*b* to provide an extension 214, while the bottom panel 202 extends outwardly beyond the end wall 200 to form an extension 216. Suitable fasteners 218 may be formed on the extensions 214 and 216 so that these extensions may be selectively secured together or separated. This permits the air baffle 198 to be folded upwardly and down against the foot section 106, so that the portion of the upper panel 112 which covers the air baffle is resting upon the portion of the upper panel which covers the foot section, as illustrated in FIG. 10*b*. This separates fastener portions 218*a* and 218*b*, as illustrated.

Industrial Applicability

The flotation mattress 10 of the present invention is designed for use with bedridden patients in homes, hospitals and nursing homes to prevent and assist in the healing process of decubitus ulcers. The novel sectional construction of this flotation mattress with the internal alternating water columns and ventilation chambers assures that the weight of the mattress is minimized while the water support provided to the patient is maximized. The open ventilation chamber construction combined with the ventilation holes 66 assures that air is pumped under the mattress and also through the ventilation holes and beneath the patient. Air circulation is enhanced by the pumping action occasioned as the patient shifts on the mattress causing expansion of the water columns and compression of the adjacent ventilation chambers to force air through the ventilation holes 66. This pumping action is facilitated by the inclined sidewalls for the water columns which also constitute the sidewalls for the ventilation chambers. The air baffles on the sides of the mattress cradle the patient within the center portion of the mattress to assure that the patient does not roll off, while the sectional construction of the mattress permits it to flex with a hosptial bed when the bed is moved to the raised position, or in its separate sectional embodiment to be handled more easily and to use selected sections when the entire mattress is not required for a particular patient.

What is claimed and desired to be secured by U.S. patent is:

1. A flotation mattress comprising a center section, a head section and a foot section, each such head, foot and center section including an outer cover means formed to define an enclosed inner area, said outer cover means including an upper panel and a lower panel extending in spaced relationship to said upper panel, and first and second sidewalls and first and second end walls extending between said upper and lower panels to form therewith said enclosed inner area, said center section having first and second center connection means formed thereon adjacent the first and second end walls respectively thereof, and said head and foot sections each having head and foot connection means respectively formed thereon adjacent to one of said first and second end walls thereof, the head connection means of said head section cooperating with said first center connection means to releasably connect said head section to said center section and said foot connection means of said foot section cooperating with said second center connection means to releasably connect said foot section to said center section, wherein each said head, foot and center section includes spaced longitudinally extending first and second air baffles extending along either side of said enclosed inner area between the first and second end walls thereof and pivot means connecting said air baffles to said head, foot and center sections for pivotal movement through a 180° arc upwardly and inwardly toward said enclosed inner area, and wherein the top panel of each said center, head and foot section extends outwardly beyond the first and second sidewalls thereof to form said pivot means and a baffle top wall for said first and second air baffles, each of said air baffles including a baffle bottom wall spaced from the respective center, head or foot section, baffle end walls extending between said baffle bottom and top walls, and first and second baffle sidewalls extending between said baffle top, bottom and end walls, one of said first or second baffle sidewalls of each said air baffle being positioned adjacent to but in spaced relation to one of the first or second sidewalls of the respective head, center or foot section.

2. The flotation mattress of claim 1, wherein said head connection means, first and second center connection means and foot connection means cooperate when said head and foot sections are connected thereby to said center section to permit said head and foot sections to pivot angularly relative to said center section.

3. The flotation mattress of claim 1, wherein said first and second center connection means are formed by extension of said upper panel for said center section beyond said center section first and second end walls, said head and foot connection means being formed by an extension of the upper panel for said head and foot sections beyond one of either said first or second second end walls for said head and foot sections respectively.

4. The flotation mattress of claim 1, wherein said foot section includes a foot air baffle extending transversely across an end thereof opposite and in spaced relation to said foot connection means and adjacent to but spaced from the first or second foot section end wall which is opposite the foot section end wall adjacent to said foot connection means, and foot section pivot means connecting said foot air baffle to said foot section in spaced relationship thereto for pivotal movement through an 180° arc upwardly and inwardly toward said enclosed inner area of said foot section.

5. A flotation mattress comprising a head section, a center section, and a foot section sequentially arranged to form a mattress body, outer cover means formed to define an enclosed inner area for said head, center and foot sections, said outer cover means including upper and lower panels extending in spaced relationship, sidewalls extending in spaced relationship between said upper and lower panels, and spaced end wall means extending between said upper and lower panels and said sidewalls to define the head, center and foot sections, and air baffle means extending along either side of said mattress body in spaced relationship to said sidewalls and pivot means connecting said air baffle means to said mattress body and spaced outwardly from the sidewalls thereof, said pivot means operating to permit pivotal movement of said air baffle means through a 180° arc upwardly and inwardly toward said enclosed inner area, wherein said head connection means and said first center connection means cooperate to form first interconnection means, and said foot connection means and said second center connection means cooperate to form second interconnection means, said first and second interconnection means each comprising a top surface contiguous with said upper panel and a bottom surface contiguous with said lower panel, whereby said first and second interconnection means each impart support to said flotation mattress at a joinder line between said head and center sections and between said foot and center sections, respectively, while permitting pivoting motion of said flotation mattress between said head and center sections and between said foot and center sections.

6. The flotation mattress of claim 5, wherein said foot section includes a foot section air baffle extending transversely across one end thereof in spaced relation to said mattress body and foot baffle pivot means connecting said foot section air baffle to said foot section and spaced outwardly from an end wall thereof, said foot baffle pivot means operating to permit pivotal movement of said foot section air baffle upwardly and inwardly toward said enclosed inner area.

7. A flotation mattress comprising three separate sequentially arranged interlockable sections including a head section, a middle section, and a foot section, each of said sections having an outer cover means including a segmented lower panel, an upper panel extending above said lower panel, and a plurality of tie walls secured between said lower and upper panels, formed to define air baffle means and an enclosed inner area, said air baffle means rotatable through an 180° arc upwardly and inwardly toward said enclosed inner area, means mounted within said enclosed inner area to form spaced inner water compartments and outer water compartments for receiving and containing water and noninflatable ventilation chamber means separate from said inner and outer water compartments, including inclined, spaced sidewalls which are secured to said upper and lower panels and which extend therebetween, each inner water compartment including a pair of said inclined, spaced sidewalls which incline outwardly away from one another from said lower panel to said upper panel, each outer water compartment including one of said tie walls and one of said inclined, spaced sidewalls which inclines outwardly away from such tie wall from said lower panel to said upper panel, the cross-sectional area of each such inner or outer water compartment being greater adjacent said upper panel than is the cross-sectional area of said water compartment adjacent said lower panel, the inclined spaced sidewalls for said inner and outer water compartments forming inclined spaced sidewalls for said ventilation chamber means positioned intermediate two adjacent water compartments, the cross-sectional area of such ventilation chamber means being greater adjacent said lower panel than is the cross-sectional area of said ventilation chamber means adjacent said upper panel, and means interconnecting a plurality of said inner and outer water chambers.

8. The flotation mattress of claim 7, wherein said lower panel is divided into a plurality of segments, each of said segments underlying separately said enclosed inner area and each said air baffle means.

9. The flotation mattress of claim 7, wherein said inner and outer water compartment means in each said head, middle and foot separate sections are interconnected, each such section including a single spout means and a single air valve means mounted on said outer cover means and communicating with said interconnected inner and outer water compartment means.

10. The flotation mattress of claim 7, wherein said inner and outer water compartment means and ventilation chamber means are alternately arranged across said enclosed inner area.

11. The flotation mattress of claim 7, wherein openings are formed in both said upper and lower panels of each said enclosed inner area for communication with each such ventilation chamber means.

12. The flotation mattress of claim 7, wherein air baffle means are formed along opposite sides of each said enclosed inner area, said air baffle means being operative to receive air under pressure and to expand in response to the receipt of such air.

13. The flotation mattress of claim 7, wherein said means to form said inner and outer water compartment means and said ventilation chamber means for each said section relatively space said inner and outer water compartment means across said enclosed inner area with said ventilation chamber means filling the area between spaced inner and outer water compartment means, the inclined spaced sidewalls for said inner and outer water compartment means forming inclined spaced sidewalls for each intermediate ventilation chamber means, the cross-sectional area of each such ventilation chamber means being greater adjacent said lower panel than is the cross-sectional area of said ventilation chamber means adjacent said upper panel.

14. The flotation mattress of claim 13, wherein said foot section and said head section are separable and interlockable at opposite ends of said middle section by corresponding attachment means mounted in peripheral margins of said top panels of each such adjacent sections.

15. The flotation mattress of claim 14, wherein said lower panel is divided into a plurality of segments, each of said segments underlying separately said enclosed inner area and each said air baffle means.

16. The flotation mattress of claim 15, wherein said inner and outer water compartment means of each said inner area are interconnected, each said inner area including a single spout means and a single air valve means mounted on said outer cover means and communicating with said interconnected inner and outer water compartment means.

17. The flotation mattress of claim 14, wherein said inner and outer water compartment means and intermediate ventilation chamber means are arranged alternately across each said inner area.

18. The flotation mattress of claim 17, wherein openings are formed in both said upper and lower panels in communication with each such ventilation chamber.

19. The flotation mattress of claim 18, wherein air baffle means are formed along opposite sides of said enclosed inner area, said air baffle means being operative to receive air under pressure and to expand in response to the receipt of such air, and to rotate through an 180° arc upwardly and inwardly toward said enclosed inner area.

20. The flotation mattress of claim 19, wherein each such ventilation chamber communicates with at least one large opening in said lower panel and with a plurality of small spaced openings in said upper panel, said small spaced openings extending beside and in spaced relation to at least one adjacent water chamber.

21. A flotation mattress of claim 20, wherein said segments of said lower panel underlying each said air baffle means and underlying said inner area are interconnectable by connection means mounted in corresponding peripheral margins of said segments of said lower panels.

22. The flotation mattress of claim 21, wherein said foot section has air baffle means along the side of said inner area opposite the side directly adjacent to said attachment means, said air baffle means being operative to receive air under pressure and to expand in response to receipt of such air, and to rotate through an 180° arc upwardly and inwardly toward said enclosed inner area.

23. A flotation mattress comprising a center section, a head section and a foot section, each such head, foot and center section including an outer cover means formed to define an enclosed inner area adopted to contain a fluid and means to add fluid to said enclosed inner area, said outer cover means including an upper panel and a lower panel extending in spaced relationship to said upper panel, and first and second sidewalls and first and second end walls extending between said upper and lower panels to form therewith said enclosed inner area, said center section having first and second center connection means formed thereon adjacent the first and second end walls respectively thereof and extending outwardly beyond said first and second end walls, said first and second center connection means being unitary and integral with said center section, and said head and foot sections each having head and foot connection means respectively formed thereon adjacent to and extending outwardly from one of said first and second end walls thereof, said head and foot connection means being unitary and integral with said head and foot sections respectively, the head connection means of said head section cooperating with said first center connection means to releasably connect said head section to said center section and said foot connection means of said foot section cooperating with said second center connection means to releasably connect said foot section to said center section, wherein said head connection means and said first center connection means cooperate to form first interconnection means, and said foot connection means and said second center connection means cooperate to form second interconnection means, said first and second interconnection means each including a top web with a top surface contiguous with said upper panel and a bottom web spaced from said top web with a bottom surface contiguous with said lower panel of the center section and an adjacent head or foot section, whereby said first and second interconnection means each impart support to said flotation mattress at a joinder line between said head and center sections and between said foot and center sections, respectively, while permitting pivoting motion of said flotation mattress between said head and center sections and between said foot and center sections.

24. The flotation mattress of claim 23 wherein said head connection means is releasably connected to said first center connection means at said top web of said first interconnection means and said foot connection means is releasably connected to said second center connection means at said top web of said second interconnection means.

25. The flotation mattress of claim 24 wherein said head connection means is releasably connected to said first center connection means at said bottom web of said first interconnection means and said foot connection means is releasably connected to said second connection means at said bottom web of said second interconnection means.

whereby said head section and said center section are releasably connected to each other, and said foot section and said center section are releasably connected to each other.

* * * * *